US007377322B2

(12) United States Patent
Hofman

(10) Patent No.: US 7,377,322 B2
(45) Date of Patent: May 27, 2008

(54) METHOD AND APPARATUS FOR CEMENTING PRODUCTION TUBING IN A MULTILATERAL BOREHOLE

(75) Inventor: Raymond A. Hofman, Midland, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 277 days.

(21) Appl. No.: 11/359,059

(22) Filed: Feb. 22, 2006

(65) Prior Publication Data

US 2006/0207765 A1 Sep. 21, 2006

Related U.S. Application Data

(63) Continuation-in-part of application No. 11/079,950, filed on Mar. 15, 2005, now Pat. No. 7,267,172.

(51) Int. Cl.
*E21B 43/14* (2006.01)

(52) U.S. Cl. ..... 166/313; 166/50; 166/387; 166/285; 166/120

(58) Field of Classification Search ..... 166/313, 166/50, 120, 387, 285
See application file for complete search history.

(56) References Cited

U.S. PATENT DOCUMENTS

| | | | | |
|---|---|---|---|---|
| 5,526,880 | A * | 6/1996 | Jordan et al. | 166/291 |
| 5,845,712 | A * | 12/1998 | Griffith, Jr. | 166/278 |
| 6,241,021 | B1 * | 6/2001 | Bowling | 166/380 |
| 6,994,165 | B2 * | 2/2006 | Roane et al. | 166/278 |
| 2006/0090906 | A1 | 5/2006 | Themig | |

FOREIGN PATENT DOCUMENTS

CA 2437678 2/2004

* cited by examiner

*Primary Examiner*—William Neuder
*Assistant Examiner*—Nicole Coy
(74) *Attorney, Agent, or Firm*—Gunn & Lee, PC; Ted D. Lee

(57) ABSTRACT

A hydraulically actuated anchor and a mechanically actuated packer are used in combination to secure a production tubing system in a lateral prior to injection of a cement to line the lateral borehole in which the production tubing is positioned. The packer is expanded to prevent fluid cement material from flowing past the packer into a junction area of the lateral with other laterals and aid the removal of superfluous cement material after hardening of the injected cement material around the production tubing system.

10 Claims, 13 Drawing Sheets

METHOD AND APPARATUS FOR CEMENTING PRODUCTION TUBING IN A MULTILATERAL BOREHOLE

CROSS-REFERENCE TO RELATED APPLICATIONS

This application is a continuation-in-part of application Ser. No. 11/079,950, filed Mar. 15, 2005 now U.S. Pat. No. 7,267,172 by Raymond A. Hofman, for a Cemented Open Hole Selective Fracing System.

BACKGROUND OF THE INVENTION

1. Field of the Invention

This invention relates generally to a method and apparatus for cementing production tubing in a multilateral borehole, and more specifically to such a method and apparatus wherein cement used for lining the borehole does not block adjacently disposed laterals.

2. Background of the Invention

Directional drilling has recently become increasingly important in the oil industry as a cost effective alternative to vertical drilling because this technique significantly improves production. To further increase production, one or more lateral wellbores may be drilled, with the greatest production being achieved from a multilateral well. Due to this increased dependence on horizontal wells, problems with lateral completion have been a growing concern.

Multilateral boreholes are commonly used to increase the production from a defined hydrocarbon production zone. The term "lateral," as used herein and in the claims, means a branch borehole extending generally radially outwardly from a pilot, or main, well borehole. The radially outwardly extending branches may be horizontally oriented or erected at a diagonal angle with respect to the axis of the main well borehole. Although not as common, the term "lateral" also includes a lateral mixed in from a preexisting lateral-that is, a lateral may be a branch off of an earlier-formed lateral.

Heretofore a problem with cementing multilateral boreholes has been that cement used to line the borehole can extrude backwardly through the borehole and block the junction of adjacent laterals with the main well borehole. For example, in the parent application of this application, a liner hanger for the production tubing extending into the lateral was placed in the main production casing of the primary wellbore and cement injected for lining around the production tubing in the lateral would fill the lateral and portion of the main well borehole up to the vicinity of the liner hanger. When multilateral boreholes are formed, if cement extrudes backwardly through the lateral being lined into the junction of an adjacent lateral, that cement will plug the junction and prevent production tubing from later being placed and cemented into the adjacent lateral.

The present invention is directed to overcoming the problem outlined above. It is desirable to have a method and apparatus for cementing production tubing into a lateral without blocking adjacently-formed laterals with the cement lining material. It is also desirable to have such a method and apparatus wherein the liner hanger is positioned in the lateral being lined and the cement lining prevented from backflowing any significant amount beyond the hanger.

SUMMARY OF THE INVENTION

In accordance with one aspect of the present invention, a method for cementing production lining in a multilateral borehole includes running production tubing into the lateral and setting an anchor spaced from a distal end of the production tubing so that the production tubing is secured in a fixed relationship with the lateral. A fluid cement material is injected through the production tubing and around an annular space around the production tubing between the external surface of the tubing and an internal surface of the lateral. The injecting of the fluid cement material is continued for a period of time sufficient to substantially fill the annular space around the production tubing from the distal end of the tubing to a packer positioned in the lateral and spaced from the distal end of the tubing. The packer is then set so that a seal is formed between the production tubing and the internal surface of the lateral.

Other features of the method for cementing production tubing in a multilateral borehole include subsequently removing fluid cement material deposits from the production tubing. Another feature subsequent to removing fluid cement material from the production tubing includes disconnecting a working tubing section from a distal end of the packer and flushing the borehole so that any residual fluid cement material from the borehole and junctions with other laterals is removed.

Still other features for the method for cementing production tubing in accordance with the present invention include hydraulically expanding at least one radially outwardly movable member of the anchor and mechanically expanding at least one radially outwardly movable member of the packer.

In another aspect of the present invention, a production tubing system adapted for fixed installation in a lateral of a multilateral borehole includes a gathering tubing section having a distal end adapted for positioning at an end of the lateral and a proximal end spaced from the distal end. The tubing system includes a hydraulically actuatable anchor having a first end connected to the proximal end of the gathering tubing section and a mechanically actuatable packer having a first end operably connected to a second end of the anchor. A working tubing section is removably attached to a second end of the packer.

Other features of the production tubing system embodying the present invention include the system having a tubing section positioned between the anchor and the packer.

Another feature of the production tubing system embodying the present invention includes the mechanically actuatable packer having at least one radially outwardly expandable seal member that is expandable only after the hydraulically actuatable anchor is actuated.

In another aspect of the present invention, an anchor-packer for use in a production tubing installation in a lateral includes a hydraulically actuatable anchor section that is attachable to a section of gathering tubing in a mechanically actuatable packer section that is attachable to a section of working tubing. The anchor-packer embodying the present invention also has at least one radially outwardly expandable seal member that is expandable only after actuation of the hydraulically actuatable anchor section.

Other features of the anchor-packer embodying the present invention include a centralizer that is adapted for connection between the anchor section and the gathering tubing and another centralizer interposed between the anchor section and the packer section.

BRIEF DESCRIPTION OF THE DRAWINGS

A more complete understanding of the method and apparatus for cementing production tubing in a multilateral borehole may be had by reference to the following detailed description when taken in conjunction with the accompanying drawings, wherein.

DESCRIPTION OF THE PREFERRED EMBODIMENTS

Figure 1:
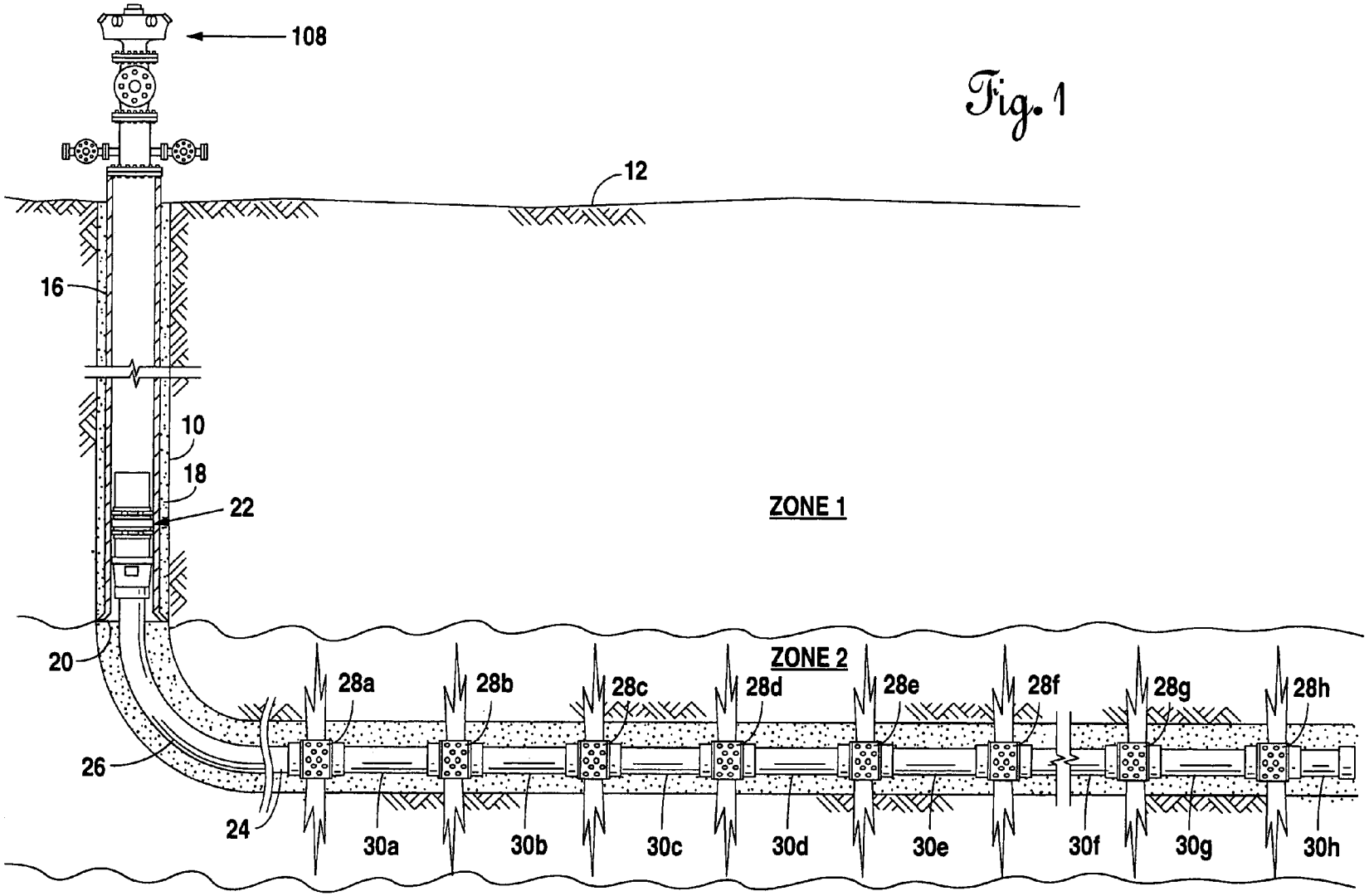
FIG. 1 is a pictorial cross-sectional view of a well with a cemented open hole fracing system in a lateral located in a production zone.

A cemented open hole selective fracing system is pictorially illustrated in FIG. 1. A production well 10 is drilled in the earth 12 to a hydrocarbon production zone 14. A casing 16 is held in place in the production well 10 by cement 18. At the lower end 20 of production casing 16 is located liner hanger 22. Liner hanger 22 may be either hydraulically or mechanically set.

Below liner hanger 22 extends production tubing 24. To extend laterally, the production well 10 and production tubing 24 bends around a radius 26. The radius 26 may vary from well to well and may be as small as 30 feet and as large as 400 feet. The radius of the bend in production well 10 and production tubing 24 depends upon the formation and equipment used.

Inside of the hydrocarbon production zone 14, the production tubing 24 has a series of sliding valves pictorially illustrated as 28*a* thru 28*h*. The distance between sliding valves 28*a* thru 28*h* may vary according to the preference of the particular operator. A normal distance is the length of a standard production tubing of 30 feet. However, the production tubing segments 30*a* thru 30*h* may vary in length depending upon where the sliding valves 28 should be located in the formation.

The entire production tubing 24, sliding valves 28, and the production tubing segments 30 are all encased in cement 32. Cement 32 located around production tubing 24 may be different from the cement 18 located around the casing 16.

In actual operation, sliding valves 28*a* thru 28*h* may be opened or closed with a shifting tool as will be subsequently described. The sliding valves 28*a* thru 28*h* may be opened in any order or sequence.

For the purpose of illustration, assume the operator of the production well 10 desires to open sliding valve 28*h*. A shifting tool 34, such as that shown in FIG. 2, connected on shifting string would be lowered into the production well 10 through casing 16 and production tubing 24. The shifting tool 34 has two elements 34*a* and 34*b* that are identical, except they are reversed in direction and connected by a shifting string segment 38. While the shifting string segment 38 is identical to shifting string 36, shifting string segment 38 provides the distance that is necessary to separate shifting tools 34*a* and 34*b*. Typically, the shifting string segment 38 would be about 30 feet in length.

Figure 3:
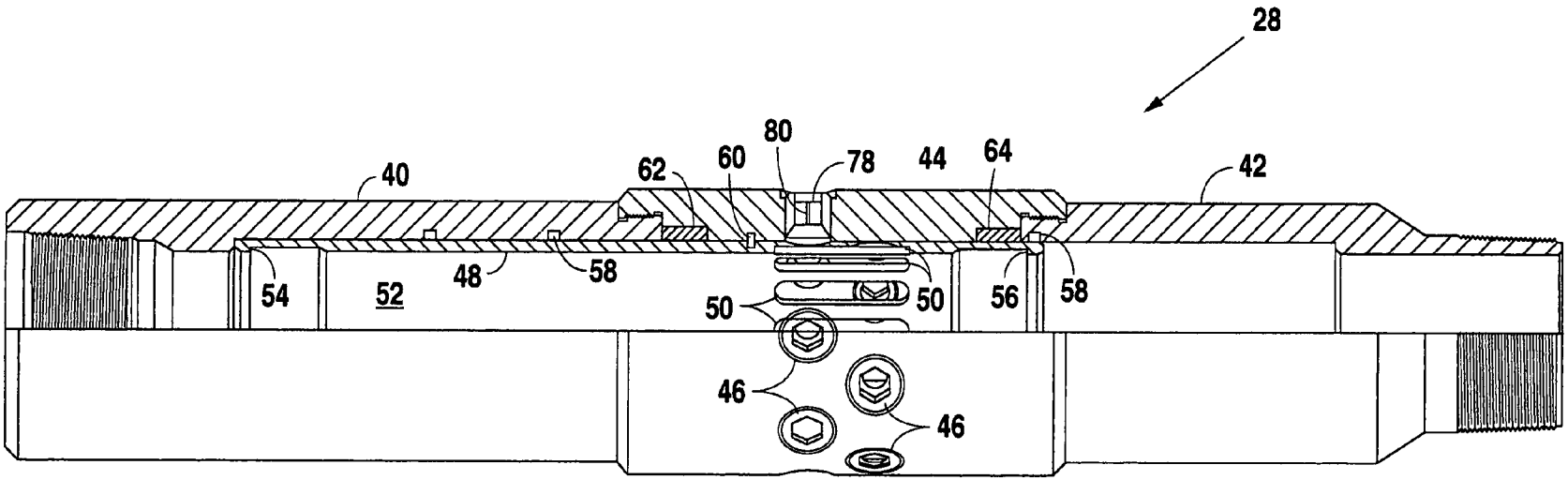
FIG. 3 is an elongated partial sectional view of a sliding valve.

To understand the operation of shifting tool 34 inside sliding valves 28, an explanation as to how the shifting tool 34 and sliding valves 28 work internally is necessary. Referring to FIG. 3, a partial cross-sectional view of the sliding valve 28 is shown. An upper housing sub 40 is connected to a lower housing sub 42 by threaded connections via the nozzle body 44. A series of nozzles 46 extend through the nozzle body 44. Inside of the upper housing sub 40, lower housing sub 42, and nozzle body 44 is an inner sleeve 48. Inside of the inner sleeve 48 are slots that allow fluid communication from the inside passage 52 through the slots 50 and nozzles 46 to the outside of the sliding valve 28. The inner sleeve 48 has an opening shoulder 54 and a closing shoulder 56 located therein.

Figure 4:
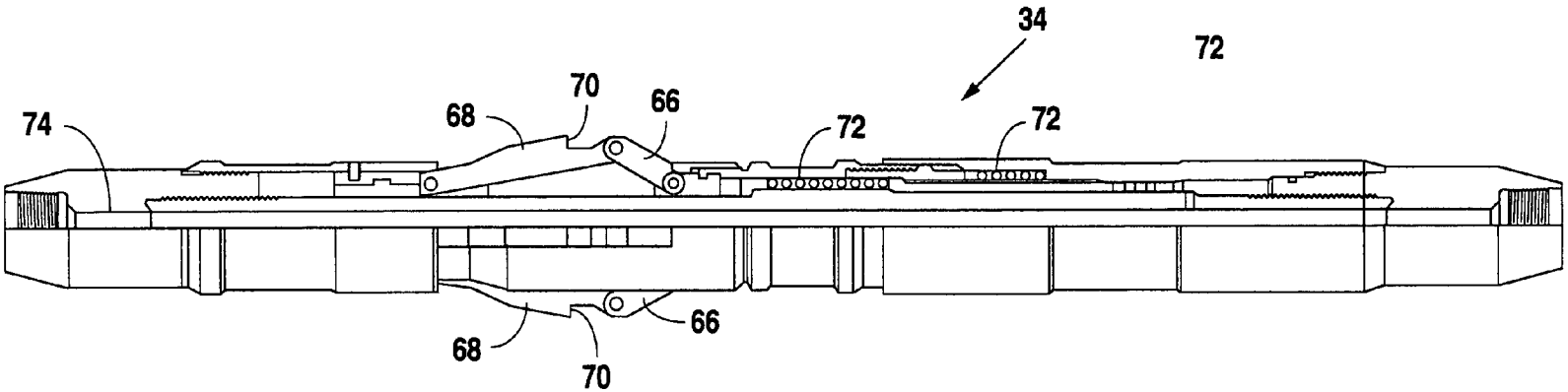
FIG. 4 is an elongated partial sectional view of a single shifting tool.

When the shifting tool 34 shown in FIG. 4 goes into the sliding valve 28, shifting tool 34*a* performs the closing function and shifting tool 34*b* performs the opening function. Shifting tools 34*a* and 34*b* are identical, except reverse and connected through the shifting string segment 38.

Figure 5A:
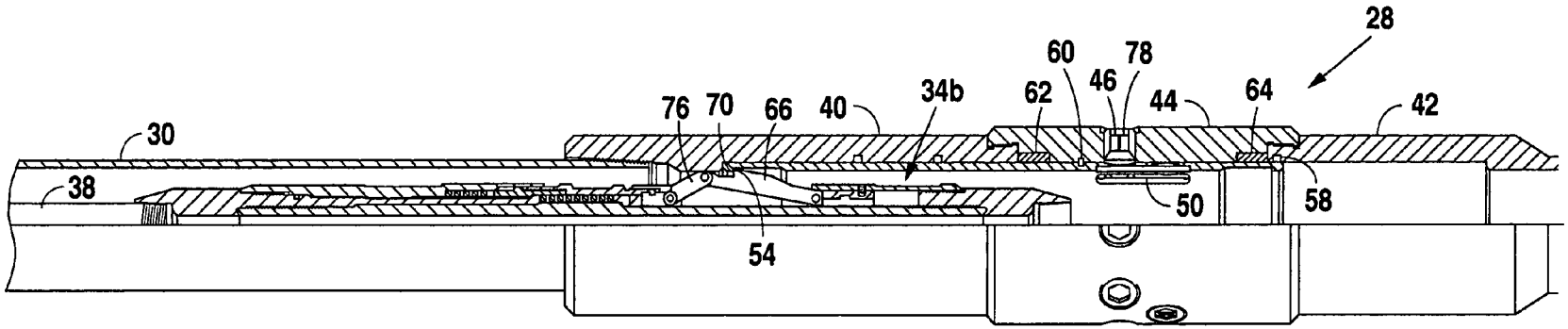
FIG. 5A is an elongated partial sectional view illustrating a shifting tool opening the sliding valve.

Assume the shifting tool 34 is lowered into production well 10 through the casing 16 and into the production tubing 24. Thereafter, the shifting tool 34 will go around the radius 26 through the shifting valves 28 and production pipe segments 30. Once the shifting tool 34*b* extends beyond the last sliding valve 28*h*, the shifting tool 34*b* may be pulled back in the opposite direction as illustrated in FIG. 5A to open the sliding valve 28, as will be explained in more detail subsequently.

Referring to FIG. 3, the sliding valve 28 has wiper seals 58 between the inner sleeve 48 and the upper housing sub 42 and the lower housing sub 44. The wiper seals 58 keep debris from getting back behind the inner sleeve 48, which could interfere with its operation. This is particularly important when sand is part of the fracing fluid.

Also located between the inner sleeve 48 and nozzle body 44 is a C-clamp 60 that fits in a notch undercut in the nozzle body 44 and into a C-clamp notch 61 in the outer surface of inner sleeve 48. The C-clamp puts pressure in the notches and prevents the inner sleeve 48 from being accidentally moved from the opened to closed position or vice versa, as the shifting tool is moving there through.

Also, seal stacks 62 and 64 are compressed between (1) the upper housing sub 40 and nozzle body 44 and (2) lower housing sub 42 and nozzle body 44, respectively. The seal stacks 62 and 64 are compressed in place and prevent leakage from the inner passage 52 to the area outside sliding valve 28 when the sliding valve is closed.

Turning now to the shifting tool 34, an enlarged partial cross-sectional view is shown in FIG. 4. Selective keys 66 extend outward from the shifting tool 34. Typically, a plurality of selective keys 66, such as four, would be contained in any shifting tool 34, though the number of selective keys 66 may vary. The selective keys 66 are spring loaded so they normally will extend outward from the shifting tool 34 as is illustrated in FIG. 4. The selective keys 66 have a beveled slope 68 on one side to push the selective keys 66 in, if moving in a first direction to engage the beveled slope 68, and a notch 70 to engage any shoulders, if moving in the opposite direction. Also, because the selective keys 66 are moved outward by spring 72, by applying proper pressure inside passage 74, the force of spring 72 can be overcome and the selective keys 66 may be retracted by fluid pressure applied from the surface.

Referring now to FIG. 5A, assume the opening shifting tool 34*b* has been lowered through sliding valve 28 and thereafter the direction reversed. Upon reversing the direction of the shifting tool 34*b*, the notch 70 in the shifting tool will engage the opening shoulder 54 of the inner sleeve 48 of sliding valve 28. This will cause the inner sleeve 48 to move from a closed position to an opened position as is illustrated in FIG. 5A. This allows fluid in the inside passage 58 to flow through slots 50 and nozzles 46 into the formation around sliding valve 28. As the inner sleeve 48 moves into the position as shown in FIG. 5A, C-clamp 60 will hold the inner sleeve 48 in position to prevent accidental shifting by engaging one of two C-clamp notches 61. Also, as the inner sleeve 48 reaches its open position and C-clamp 60 engages, simultaneously the inner diameter 59 of the upper housing sub 40 presses against the slope 76 of the selective key 66, thereby causing the selective keys 66 to move inward and notch 70 to disengage from the opening shoulder 54.

Figure 5B:
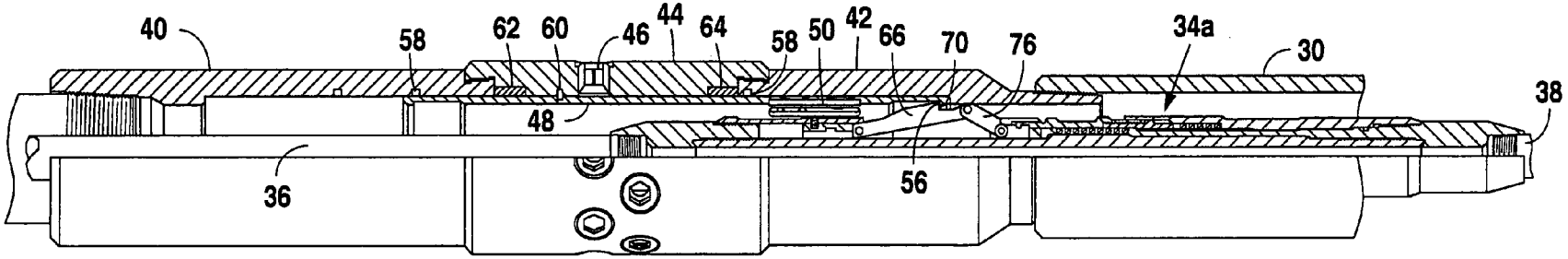
FIG. 5B is an elongated partial sectional view illustrating a shifting tool closing the sliding valve.

If it is desired to close a sliding valve 28, the same type of shifting tool will be used, but in the reverse direction, as illustrated in FIG. 5B. The shifting tool 34*a* is arranged in the opposite direction so that now the notch 70 in the selective keys 66 will engage closing shoulder 56 of the inner sleeve 48. Therefore, as the shifting tool 34*a* is lowered through the sliding valve 28, as shown in FIG. 5B, the inner sleeve 48 is moved to its lowermost position and flow between the slots 50 and nozzles 46 is terminated. The seal stacks 62 and 64 insure there is no leakage. Wiper seals 58 keep the crud from getting behind the inner sleeve 48.

Also, as the shifting tool 34A moves the inner sleeve 48 to its lowermost position, pressure is exerted on the slope 76 by the inner diameter 61 of lower housing sub 42 of the selective keys 66 to disengage the notch 70 from the closing shoulder 56. Simultaneously, the C-clamp 60 engages in another C-clamp notch 61 in the outer surface of the inner sleeve 48.

Figure 2:
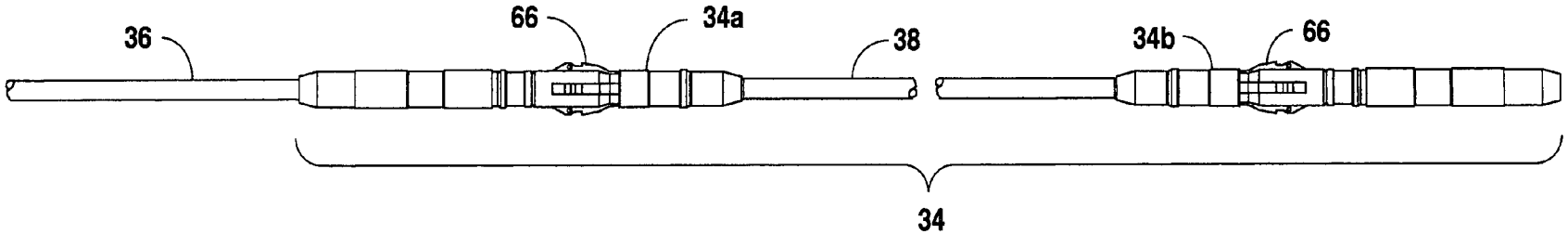
FIG. 2 is a longitudinal view of shifting tool.

If the shifting tool 34, as shown in FIG. 2, was run into the production well 10 as shown in FIG. 1, the shifting tool 34 and shifting string 36 would go through the internal diameter of casing 16, internal opening of hanger liner 22, through the internal diameter of production tubing 24, as well as through sliding valves 28 and production pipe segments 30. Pressure could be applied to the internal passage 74 of shifting tool 34 through the shifting string 36 to overcome the pressure of springs 72 and to retract the selective keys 66 as the shifting tool 34 is being inserted. However, on the other hand, even without an internal pressure, the shifting tool 34*b*, due to the beveled slope 68, would not engage any of the sliding valves 28*a* thru 28*h* as it is being inserted. On the other hand, the shifting tool 34*a* would engage each of the sliding valves 28 and make sure the inner sleeve 48 is moved to the closed position. After the shifting tool 34*b* extends through sliding valve 28*h*, shifting tool 34*b* can be moved back towards the surface causing the sliding valve 28*h* to open. At that time, the operator of the well can send fracing fluid through the annulus between the production tubing 24 and the shifting string 36. Normally, an acid would be sent down first to dissolve the acid soluble cement 32 around sliding valve 28 (see FIG. 1). After dissolving the cement 32, the operator has the option to frac around sliding valve 28*h*, or the operator may elect to dissolve the cement around other sliding valves 28*a* thru 28*g*. Normally, after dissolving the cement 32 around sliding valve 28*h*, then shifting tool 34*a* would be inserted there through, which closes sliding valve 28*h*. At that point, the system would be pressure checked to insure sliding valve 28*h* was in fact closed. By maintaining the pressure, the selective keys 66 in the shifting tool 34 will remain retracted and the shifting tool 34 can be moved to shifting valve 28*g*. The process is now repeated for shifting valve 28*g*, so that shifting tool 34*b* will open sliding valve 28*g*. Thereafter, the cement 32 is dissolved, sliding valve 28*g* closed, and again the system pressure checked to insure valve 28*g* is closed. This process is repeated until each of the sliding valves 28*a* thru 28*h* has been opened, the cement dissolved, pressure checked after closing, and now the system is ready for fracing.

By determining the depth from the surface, the operator can tell exactly which sliding valve 28*a* thru 28*h* is being opened. By selecting the combination the operator wants to open, then fracing fluid can be pumped through casing 16, production tubing 24, sliding valves 28, and production tubing segments 30 into the formation.

By having a very limited area around the sliding valve 28 that is subject to fracing, the operator now gets fracing deeper into the formation with less fracing fluid. The increase in the depth of the fracing results in an increase in production of oil or gas. The cement 32 between the respective sliding valves 28*a* thru 28*h* confines the fracing fluids to the areas immediately adjacent to the sliding valves 28*a* thru 28*h* that are open.

Any particular combination of the sliding valves 28*a* thru 28*h* can be selected. The operator at the surface can tell when the shifting tool 34 goes through which sliding valves 28*a* thru 28*h* by the depth and increased force as the respective sliding valve is being opened or closed.

Applicant has just described one type of mechanical shifting of mechanical shifting to 34. Other types of shifting tools may be used including electrical, hydraulic, or other mechanical designs. While shifting tool 34 is tried and proven, other designs may be useful depending on how the operator wants to produce the well. For example, the operator may not want to separately dissolve the cement 32 around each sliding valve 28, and pressure check, prior to fracing. The operator may ant to open every third sliding valve 28, dissolve the cement, then frac. Depending upon the operator preference, some other type shifting tool may be easily be used.

Another aspect of the invention is to prevent debris from getting inside sliding valves 28 when the sliding valves 28 are being cemented into place inside of the open hole. To prevent the debris from flowing inside the sliding valve 28, a plug 78 is located in nozzle 46. The plug 78 can be dissolved by the same acid that is used to dissolve the cement 32. For example, if a hydrochloric acid is used, by having a weep hole 80 through an aluminum plug 78, the aluminum plug 78 will quickly be eaten up by the hydrochloric acid. However, to prevent wear at the nozzles 46, the area around the aluminum plus 78 is normally made of titanium. The titanium resists wear from fracing fluids, such as sand.

While the use of plug 78 has been described, plugs 78 may not be necessary. If the sliding valves 28 are closed and the cement 32 does not stick to the inner sleeve 48, plugs 78 may be unnecessary. It all depends on whether the cement 32 will stick to the inner sleeve 48.

Further, the nozzle 46 may be hardened any of a number of ways instead of making the nozzles 46 out of Titanium. The nozzles 46 may be (a) heat treated, (b) frac hardened, (c) made out of tungsten carbide, (d) made out of hardened stainless steel, or (e) made or treated any of a number of different ways to decrease and increase productive life.

Figure 6:
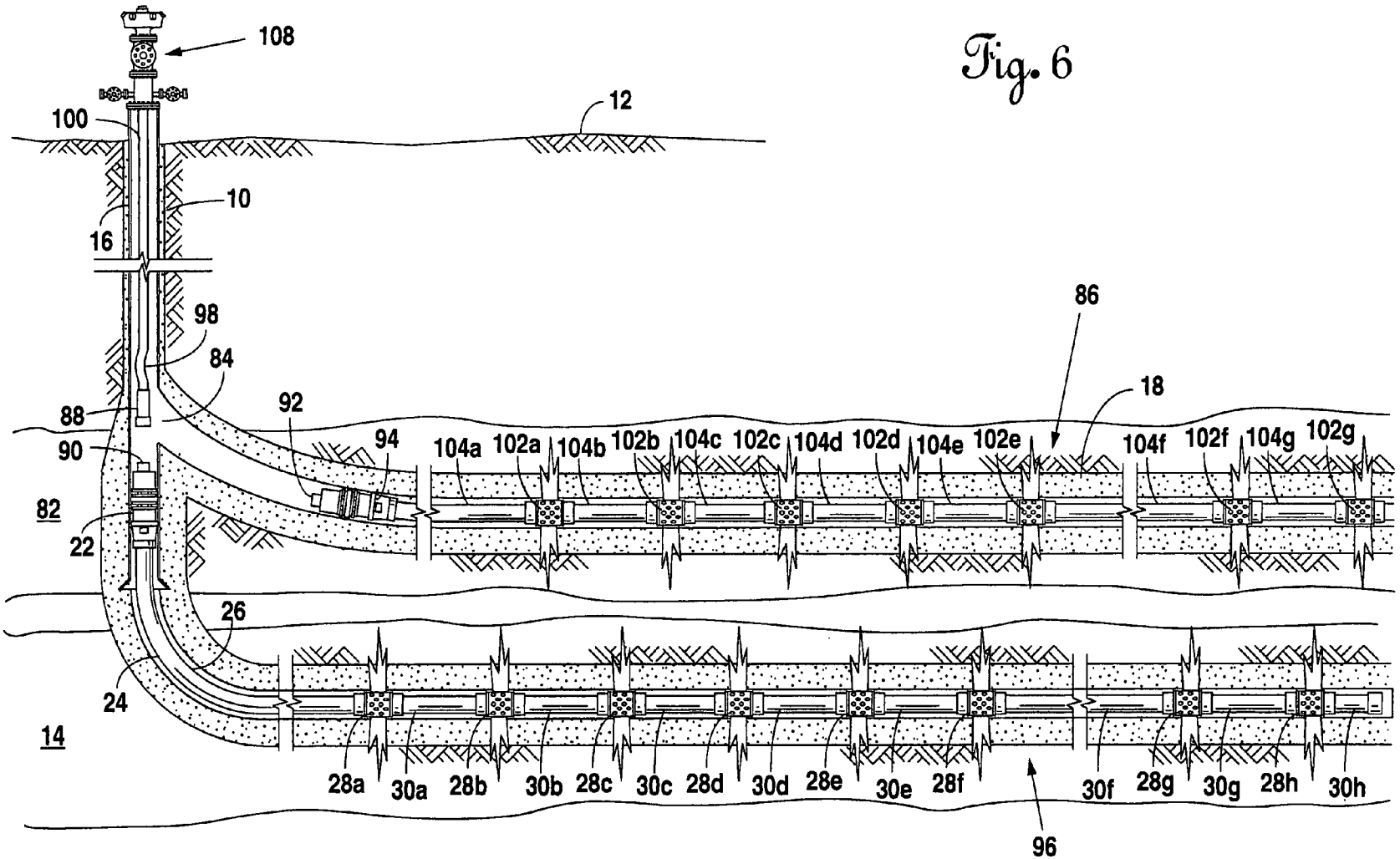
FIG. 6 is a pictorial sectional view of a cemented open hole fracing system having multilaterals.

Assume the system as just described is used in a multi-lateral formation as shown in FIG. 6. Again, the production well 10 is drilled into the earth 12 and into a hydrocarbon production zone 14, but also into hydrocarbon production zone 82. Again, a liner hanger 22 holds the production tubing 24 that is bent around a radius 26 and connects to sliding valves 28*a* thru 28*h*, via production pipe segments 30*a* thru 30*h*. The production of zone 14, as illustrated in FIG. 6, is the same as the production as illustrated in FIG. 1. However, a window 84 has now been cut in casing 16 and cement 18 so that a horizontal lateral 86 may be drilled there through into hydrocarbon production zone 82.

In the drilling of multi-lateral wells, an on/off tool 88 is used to connect to the stinger 90 on the liner hanger 22 or the stinger 92 on packer 94. Packer 94 can be either a hydraulic set or mechanical set packer to the wall 81 of the horizontal lateral 86. In determining which lateral 86 or 96, the operator is going to connect to, a bend 98 in the vertical production tubing 100 helps guide the on/off tool 88 to the proper lateral 86 or 96. The sliding valves 102*a* thru 102*g* may be identical to the sliding valves 28*a* thru 28*h*. The only difference is sliding valves 102*a* thru 102*g* are located in hydrocarbon production zone 82, which is drilled through the window 84 of the casing 16. Sliding valves 102*a* thru 102*g* and production tubing 104*a* thru 104*g* are cemented into place past the packer 94 in the same manner as previously described in conjunction with FIG. 1. Also, the sliding valves 102*a* thru 102*g* are opened in the same manner as sliding valves 28*a* thru 28*h* as described in conjunction with FIG. 1. Also, the cement 106 may be dissolved in the same manner.

Just as the multi laterals as described in FIG. 6 are shown in hydrocarbon production zones 14 and 82, there may be other laterals drilled in the same zones 14 and/or 82. There is no restriction on the number of laterals that can be drilled nor in the number of zones that can be drilled. Any particular sliding valve may be operated, the cement dissolved, and fracing begun. Any particular sliding valve the operator wants to open can be opened for fracing deep into the formation adjacent the sliding valve.

By use of the system as just described, more pressure can be created in a smaller zone for fracing than is possible with prior systems. Also, the size of the tubulars is not decreased the further down in the well the fluid flows. The decreasing size of tubulars is a particular problem for a series of ball operated valves, each successive ball operated valve being smaller in diameter. This means the same fluid flow can be created in the last sliding valve at the end of the string as would be created in the first sliding valve along the string. Hence, the flow rates can be maintained for any of the selected sliding valves 28*a* thru 28*h* or 102*a* thru 102*g*. This results in the use of less fracing fluid, yet fracing deeper into the formation at a uniform pressure regardless of which sliding valve through which fracing may be occurring. Also, the operator has the option of fracing any combination or number of sliding valves at the same time or shutting off other sliding valves that may be producing undesirables, such as water.

Figure 7:
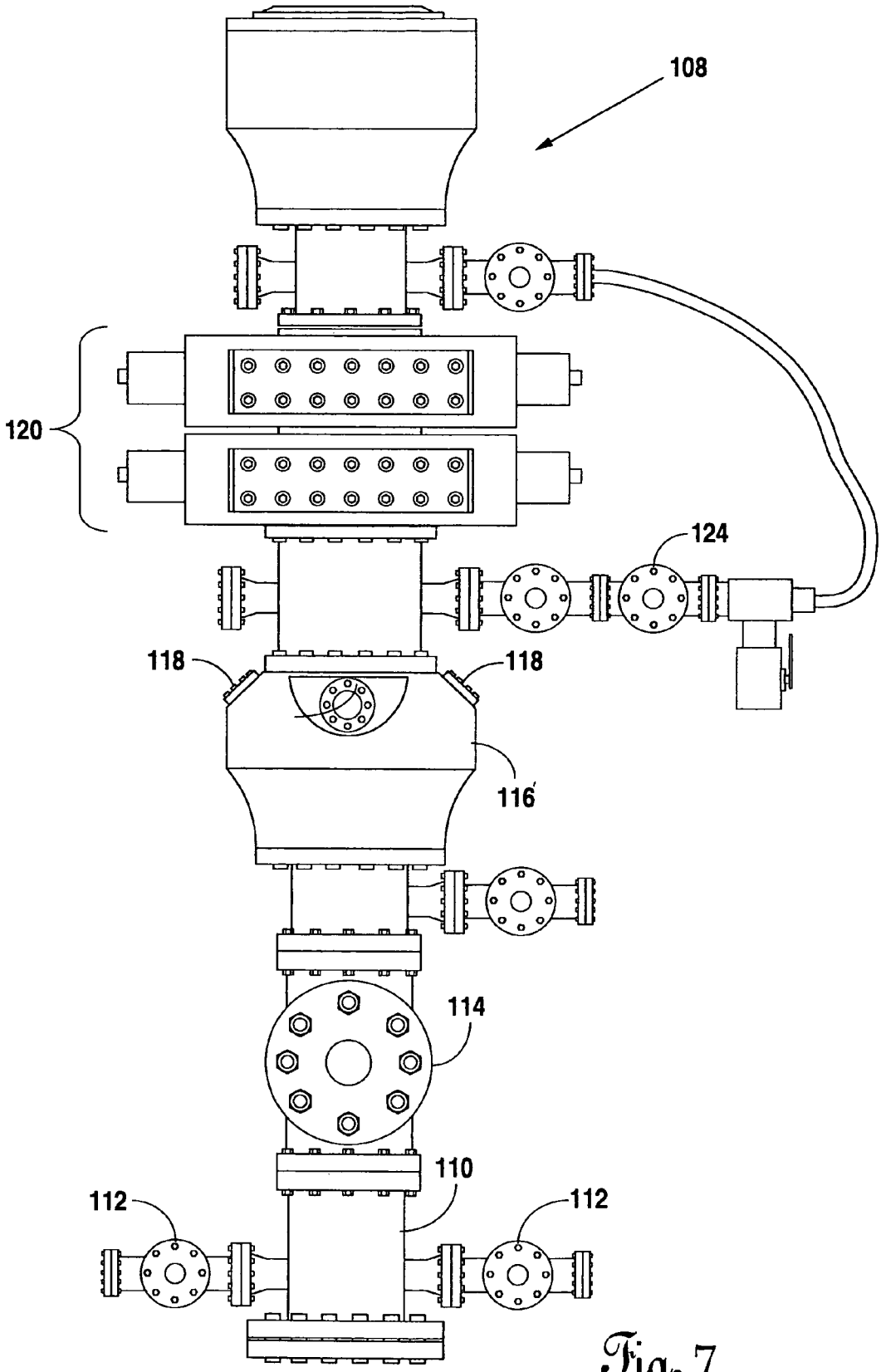
FIG. 7 is an elevated view of a wellhead.

On the top of casing 18 of production well 10 is located a wellhead 108. While many different types of wellheads are available, the wellhead preferred by applicant is illustrated in further detail in FIG. 7. A flange 110 is used to connect to the casing 16 that extends out of the production well 10. On the sides of the flange 110 are standard valves 112 that can be used to check the pressure in the well, or can be used to pump things into the well. A master valve 114 that is basically a float control valve provides a way to shut off the well in case of an emergency. Above the master valve 114 is a goat head 116. This particular goat head 116 has four points of entry 118, whereby fracing fluids, acidizing fluids or other fluids can be pumped into the well. Because sand is many times used as a fracing fluid and is very abrasive, the goat head 116 is modified so sand that is injected at an angle to not excessively wear the goat head. However, by adjusting the flow rate and/or size of the opening, a standard goat head may be used without undue wear.

Above the goat head 116 is located blowout preventer 120, which is standard in the industry. If the well starts to blow, the blowout preventer 120 drives two rams together and squeezes the pipe closed. Above the blowout preventer 120 is located the annular preventer 122. The annular preventer 122 is basically a big balloon squashed around the pipe to keep the pressure in the well bore from escaping to atmosphere. The annular preventer 122 allows access to the well so that pipe or tubing can be moved up and down there through. The equalizing valve 124 allows the pressure to be equalized above and below the blow out preventer 120. The equalizing of pressure is necessary to be able to move the pipe up and down for entry into the wellhead. All parts of the wellhead 108 are old, except the modification of the goat head 116 to provide injection of sand at an angle to prevent excessive wear. Even this modification is not necessary by controlling the flow rate.

Figure 8:
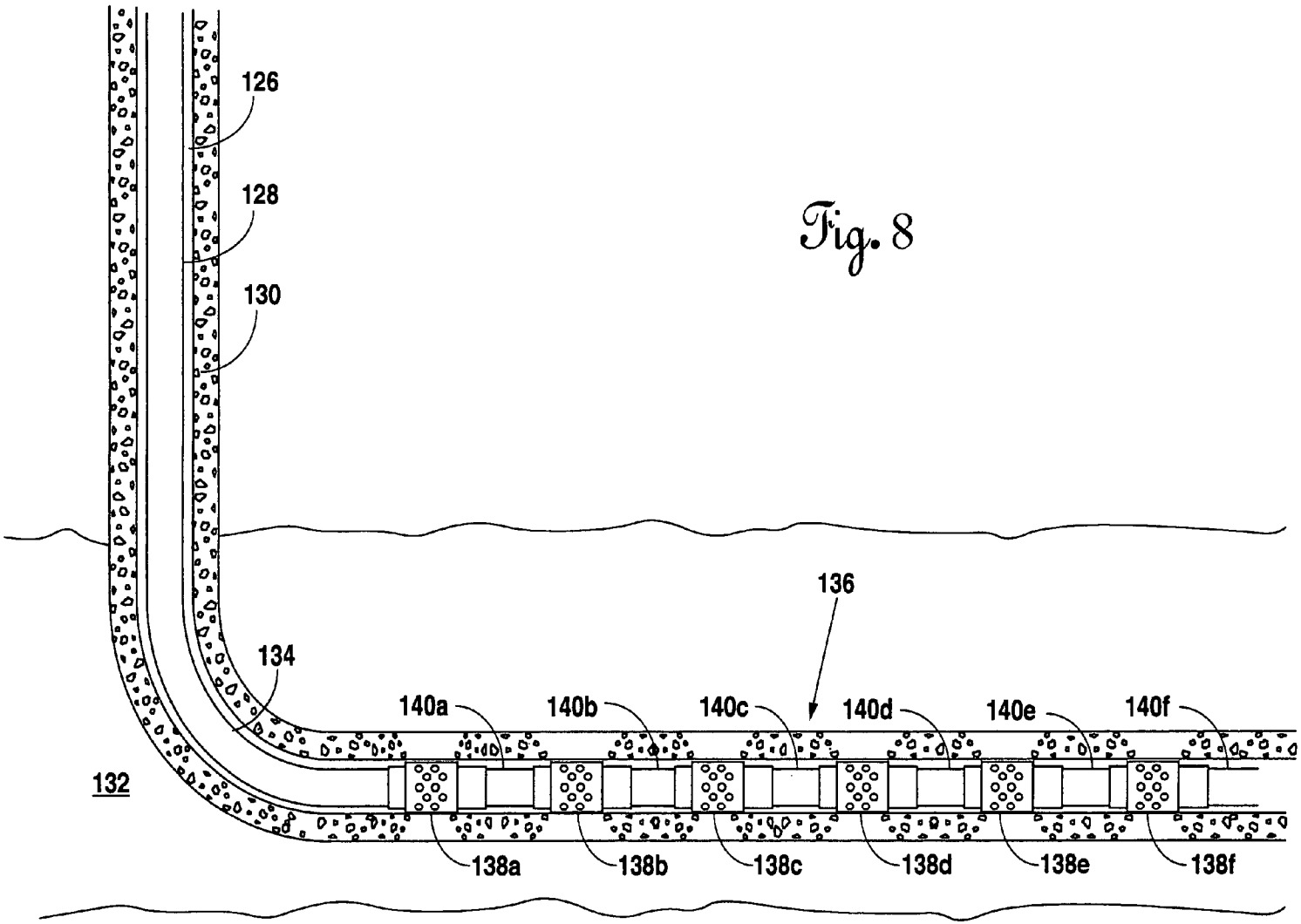
FIG. 8 is a cemented open hole horizontal fracing system.

Turning now to FIG. 8, the system as presently described has been installed in a well 126 without vertical casing. Well 126 has production tubing 128 held into place by cement 130. In the production zone 132, the production tubing 128 bends around radius 134 into a horizontal lateral 136 that follows the production zone 132. The production tubing 128 extends into production zone 132 around the radius 134 and connects to sliding valves 38*a* thru 38*f*, through production tubing segments 140*a* thru 140*f*. Again, the sliding valves 138*a* thru 138*f* may be operated so the cement 130 is dissolved therearound. Thereafter, any of a combination of sliding valves 138*a* thru 138*f* can be operated and the production zone 132 fraced around the opened sliding valve. In this type of system, it is not necessary to cement into place a casing nor is it necessary to use any type of packer or liner hanger. The minimum amount of hardware is permanently connected in well 126, yet fracing throughout the production zone 132 in any particular order as selected by the operator can be accomplished by simply fracing through the selected sliding valves 138*a* thru 138*f*.

Figure 9:
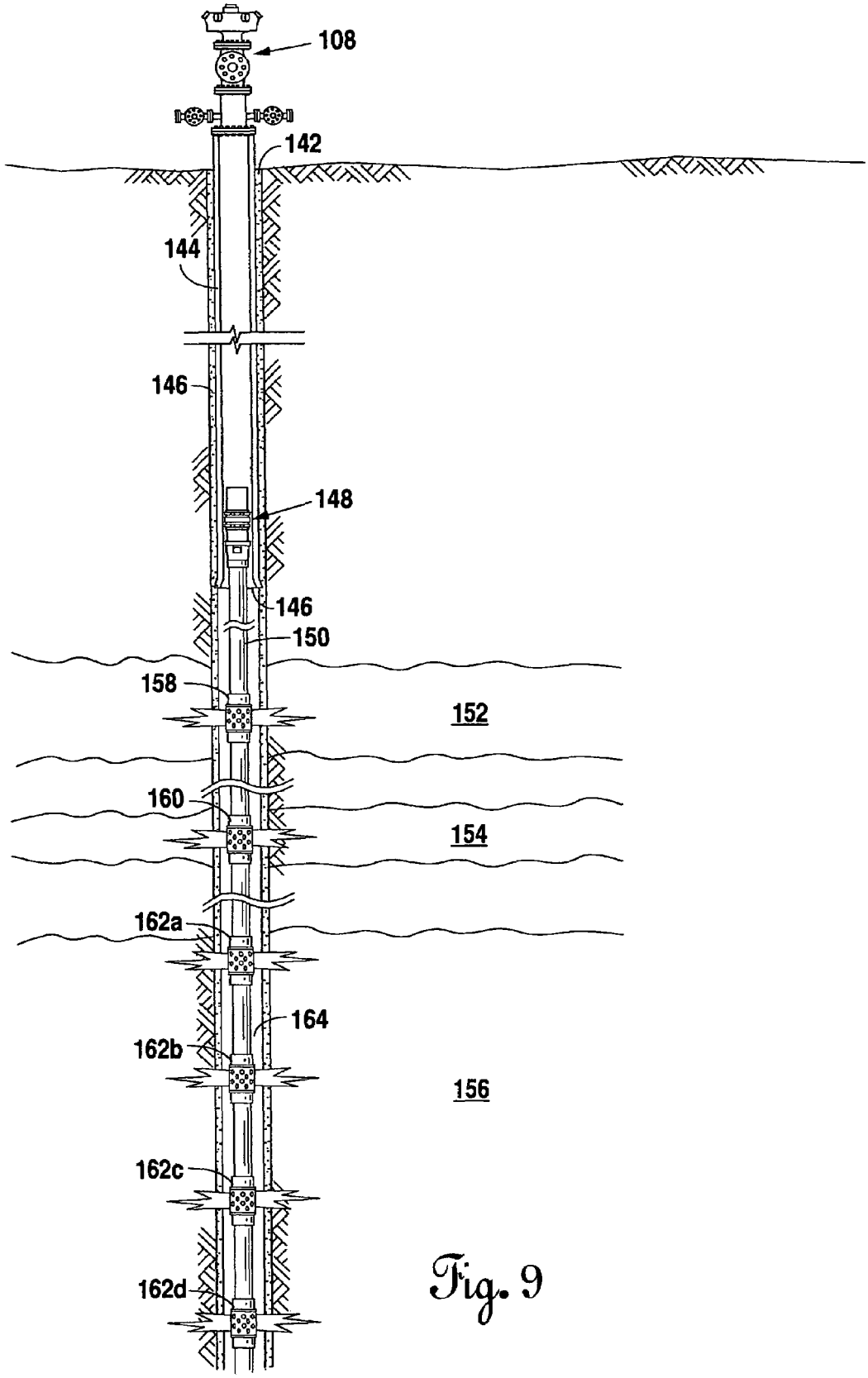
FIG. 9 is a cemented open hole vertical fracing system.

The system previously described can also be used for well 140 that is entirely vertical as shown in FIG. 9. The wellhead 108 connects to casing 144 that is cemented into place by cement 146. At the bottom 147 of casing 144 is located a liner hanger 148. Below liner hanger 148 is production tubing 150. In the well 144, as shown in FIG. 9, there are producing zones 152, 154, and 156. After the production tubing 150 and sliding valves 158, 160, and 162*a* thru 162*d* are cemented into place by acid soluble cement 164, the operator may now produce all or selected zones. For example, by dissolving the cement 164 adjacent sliding valve 158, thereafter, production zone 152 can be fraced and produced through sliding valve 158. Likewise, the operator could dissolve the cement 164 around sliding valve 160 that is located in production zone 154. After dissolving the cement 164 around sliding valve 160, production zone 154 can be fraced and later produced.

On the other hand, if the operator wants to have multiple sliding valves 162*a* thru 162*d* operate in production zone 156, the operator can operate all or any combination of the sliding valves 162*a* thru 162*d*, dissolve the cement 164 therearound, and later frac through all or any combination of the sliding valves 162*a* thru 162*d*. By use of the method as just described, the operator can produce whichever zone 152, 154 or 156 the operator desires with any combination of selected sliding valves 158, 160 or 162.

By use of the method as just described, the operator, by cementing the sliding valves into the open hole and thereafter dissolving the cement, fracing can occur just in the area adjacent to the sliding valve. By having a limited area of fracing, more pressure can be built up into the formation with less fracing fluid, thereby causing deeper fracing into the formation. Such deeper fracing will increase the production from the formation. Also, the fracing fluid is not wasted by distributing fracing fluid over a long area of the well, which results in less pressure forcing the fracing fluid deep into the formation. In fracing over long areas of the well, there is less desirable fracing than what would be the case with the present invention.

The above-description illustrates the selective fracing system embodying the present invention with respect to a single open hole. However, as described above, directional drilling has recently become increasingly important to the oil industry. In directional drilling, one or more lateral wellbores are drilled to further increase production with the greatest production being achieved in a multilateral well. In multilateral wells, such as illustrated in FIG. 6, it can been seen that cement can extrude back through the production well to a point where it impinges on or enters into another lateral, making it impossible to later use that lateral either for the placement of production tubing or placement and cementing in of production tubing or extraction of hydrocarbon from the plugged lateral.

Figure 10:
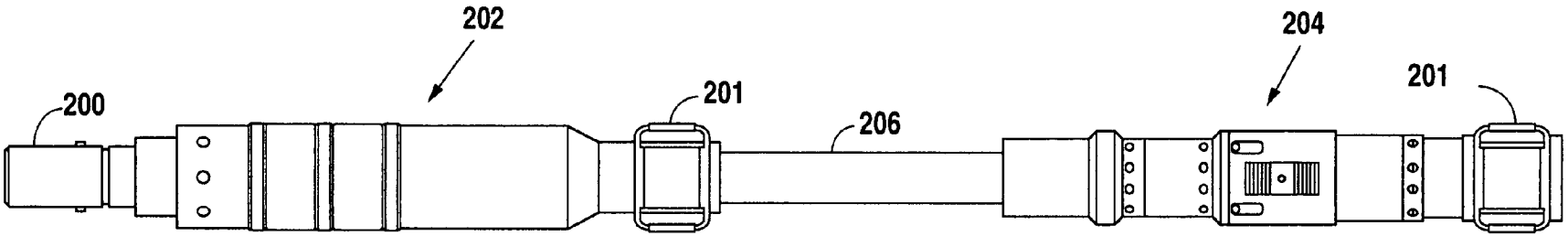
FIG. 10 is a side view of an anchor-packer embodying the present invention.
Figure 17:
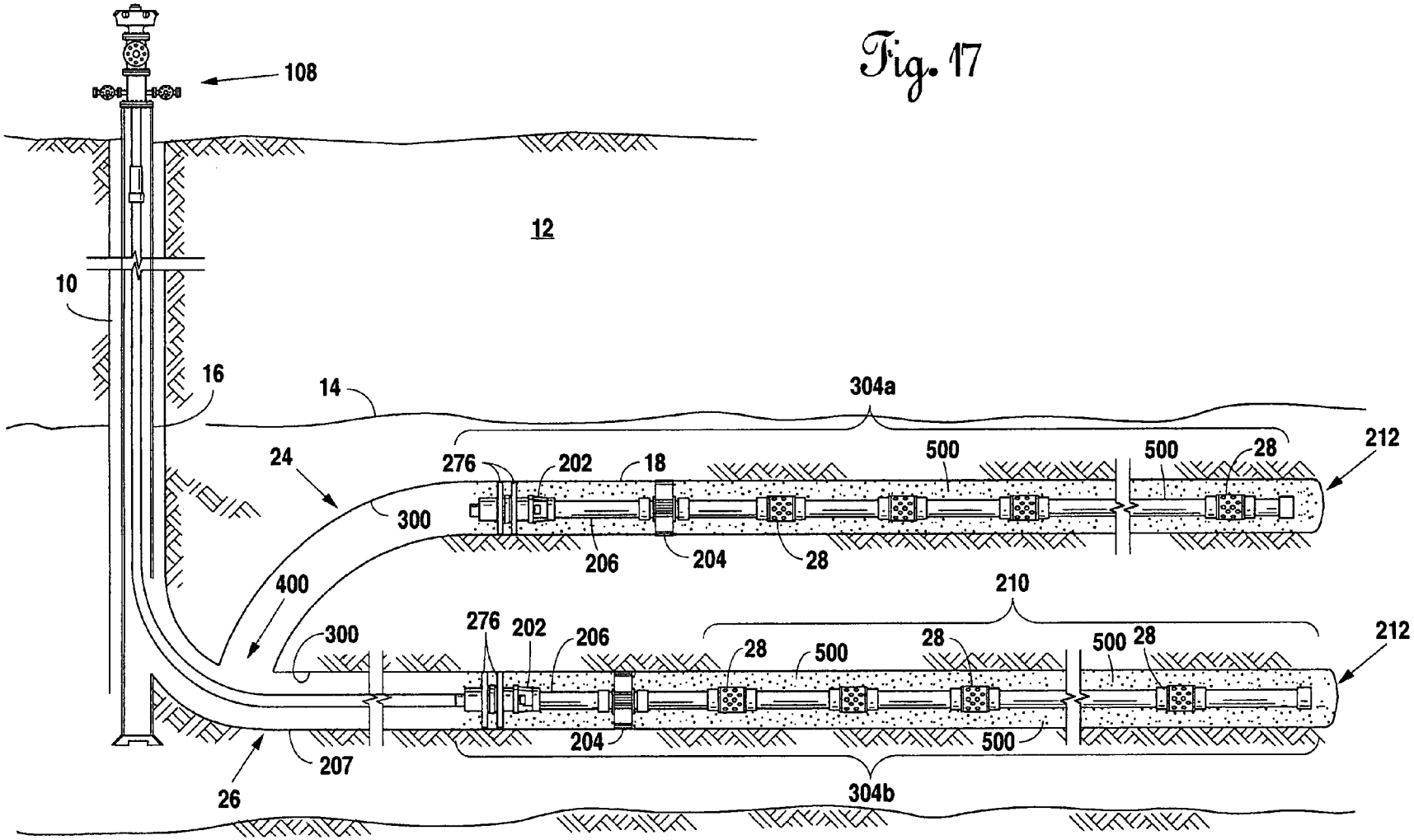
FIG. 17 is a somewhat pictorial cross-sectional view of the production tubing system embodying the present invention.

FIG. 10 shows a side view of the preferred embodiment of the present invention. An open hole packer 202 and an open hole anchor 204 are provided on either end of a tubing section 206, which is a section of production pipe inserted to make the assembly more limber and easier to run down a well. A pair of centralizers 201 are located at the bottom and middle of the anchor-packer to keep it positioned concentrically in a wellbore and to hold the anchor-packer off the bottom of a lateral, thus protecting the anchor-packer as it is run into the production well. In addition, the centralizers 201 push debris ahead of the anchor-packer as it is run into the wellbore. An on/off connector 200 allows a work string 207 to be attached to the packer 202 (see FIG. 17), and is used to mechanically set the packer 202 by rotating the work string 207. When set, the packer 202 forms a seal between an outer surface of the packer 202 and a wall 300 of a lateral 26, as illustrated in FIG. 17, thus isolating the lateral 26 from any fluids and pressures applied from above the packer 202. The anchor 204 keeps the anchor-packer in a stationary position so that compression weight can be applied to the packer 202 for setting and other purposes at the appropriate times.

Figure 11:
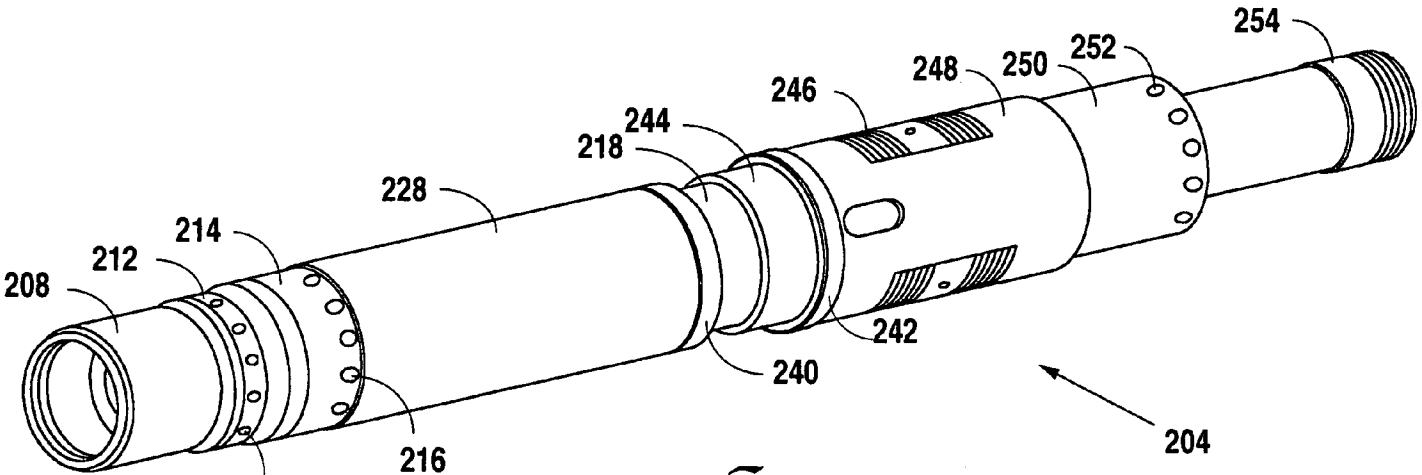
FIG. 11 is a perspective view of an anchor section of the production tubing system embodying the present invention.
Figure 12:
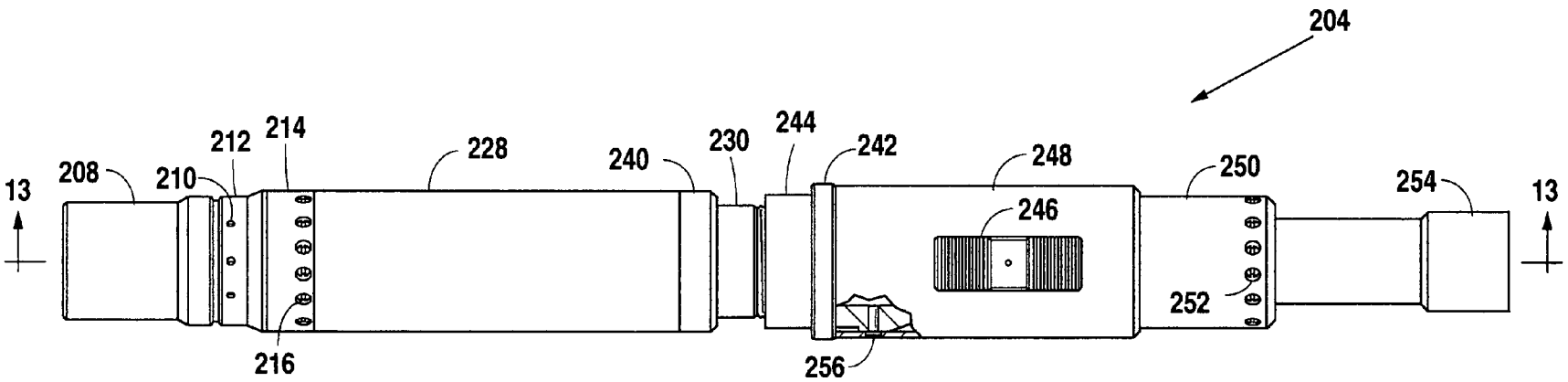
FIG. 12 is a side view of the anchor section of the production tubing system embodying the present invention.

FIG. 11 is a perspective view of the anchor 204 in the preferred embodiment of the present invention, while FIG. 12 shows a side view of the anchor 204. The anchor 204 provides a tubing section 208 positioned adjacent a jam nut 212. A plurality of set screws 210 fasten the tubing section 208 to the jam nut 212, thus preventing the tubing section 208 from sliding relative to the jam nut 212. An upper piston stop 214 is positioned between the jam nut 212 and an outer cylinder 228, and secured in place by a plurality of set screws 216. A lock housing 240 is fastened to the outer cylinder 228 by a plurality of screws 238 (see FIG. 13). A partially enclosed lower piston 230 protrudes from the outer cylinder 228 and the lock housing 240, providing a threaded means for connection of an upper cone 244. A slip cage 248, which is screwed into a slip cage cap 242, is positioned around the upper cone 244 with an inclined surface 244*a*, slips 246 with lower slip faces 246*b*, and a portion of a lower cone 250, which has an inclined surface 250*a*. Until and if a well operator removes the invention from the wellbore, the lower cone 250 is fastened to a mandrel 254 by shear pins 252. As shown in FIG. 12, torque pins 256 prevent the slip cage 248 and slips 246 from spinning relative to the upper cone 244.

Figure 13:
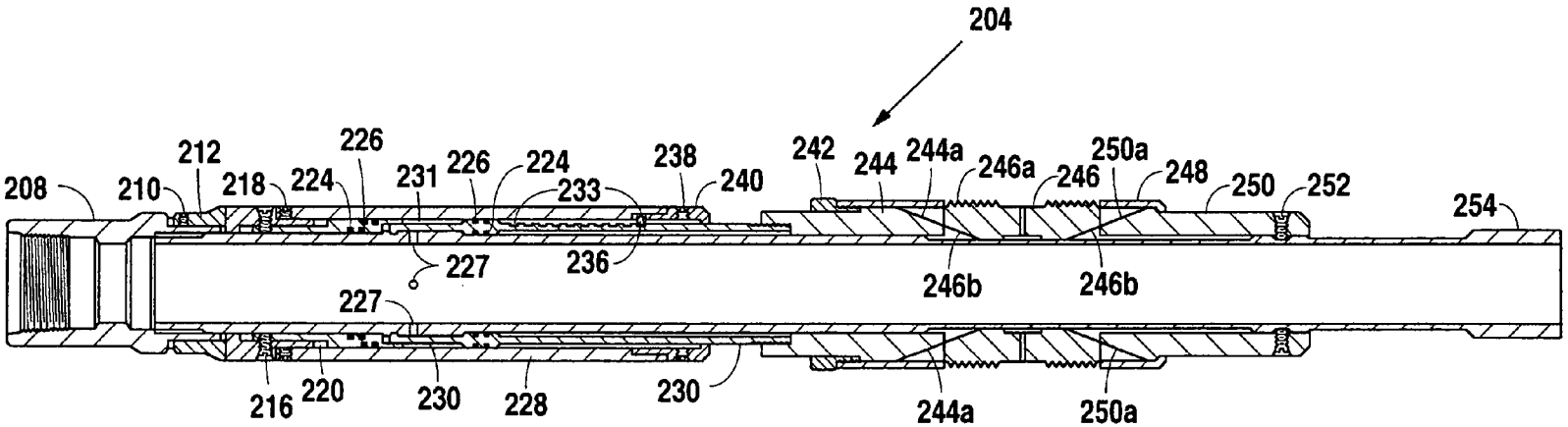
FIG. 13 is a longitudinal sectional view of the anchor member of the production tubing system embodying the present invention.

FIG. 13 shows a longitudinal section taken along the line 13-13 of FIG. 12. To set the anchor 204 in the wall 300 of the lateral 26 (see FIG. 17), a plug is first run below the assembly to allow the buildup of fluid pressure when fluid is pumped down the well. Fluid is then pumped inside the anchor 204 through the tubing section 208. As the plug resists fluid flow, fluid leaves the mandrel 254 through a plurality of holes 227, filling a chamber 231 between the upper piston 220 and the lower piston 230, enclosed by the mandrel 254 and the outer cylinder 228. Lower o-rings 224 and upper o-rings 226, a pair of each of which is located on both the upper piston 220 and lower piston 230, prevent fluid from leaving the chamber 231, and as fluid pressure inside the chamber 231 increases, the lower piston 230 is forced down the anchor 204 toward the upper cone 244.

As the lower piston 230 moves down the anchor 204, a lock 236 engages the lower piston 230 by dropping into one of a plurality of lock notches 233, thus preventing the lower piston 230 from moving up the mandrel 254 toward the upper piston 220. Each lock notch 233 is configured in such a manner so as to allow the lock 236 to easily move out of the lock notch 233 as the lower piston 230 moves down the mandrel 254, but to force the lock 236 to remain in the lock notch 233 to resist any movement of the lower piston 230 up the mandrel 254. Thus, the lock 236 engages the lock notches 233 of the lower piston 230 such that the lower piston 230 can only be moved down the mandrel 254 toward the upper cone 244.

As the lower piston 230 moves down the mandrel 254, the upper cone 244, which is threaded to the lower piston 230, also moves down the mandrel 254. Because the slips 246 are supported by the slip cage 248 and the slip cage 248 is supported by the upper cone 244, as the upper cone 244 moves down the mandrel 254, the slips 246 and slip cage 248 also move down the mandrel 254. As the lower slip face 246*b* contacts the lower cone 250, the inclined surface 250*a* of the lower cone 250 exerts a radially outward force on the slips 246, causing the slips 246 to move away from the mandrel 254 and toward the wall 300 of the open lateral 26 (see FIG. 17). The slip teeth 246*a* thus engage the wall 300 of the open lateral 26 (see FIG. 17), securing the anchor 204 and attached assembly against movement upwardly or downwardly in the hole.

A well operator could later unset the anchor 204 by exerting a compression force on the anchor 204 in excess of the shear strength of the shear pins 252, which would break the shear pins 252, allowing the lower cone 250 to move down the mandrel 254 and away from the upper cone 244. The weight of the slips 246 and force exerted on the slips 246 by the wall 300 of the lateral 26 (see FIG. 17) push the slips 246 away from the wellbore and toward the mandrel 254. As the lower slip face 246*b* pushes the inclined surface 250*a* of the lower cone 250, the lower cone 250 is free to move along the mandrel 254. The slips 246 thus recede from the wall 300 of the lateral 26 (see FIG. 17) and into the slip cage 248, and the anchor 204 and assembly can be moved along the lateral 26 (see FIG. 17). The anchor 204, however, cannot be reset without replacing the shear pins 252 to once again restrict the movement of the lower cone 250 relative to the mandrel 254.

Figure 14:
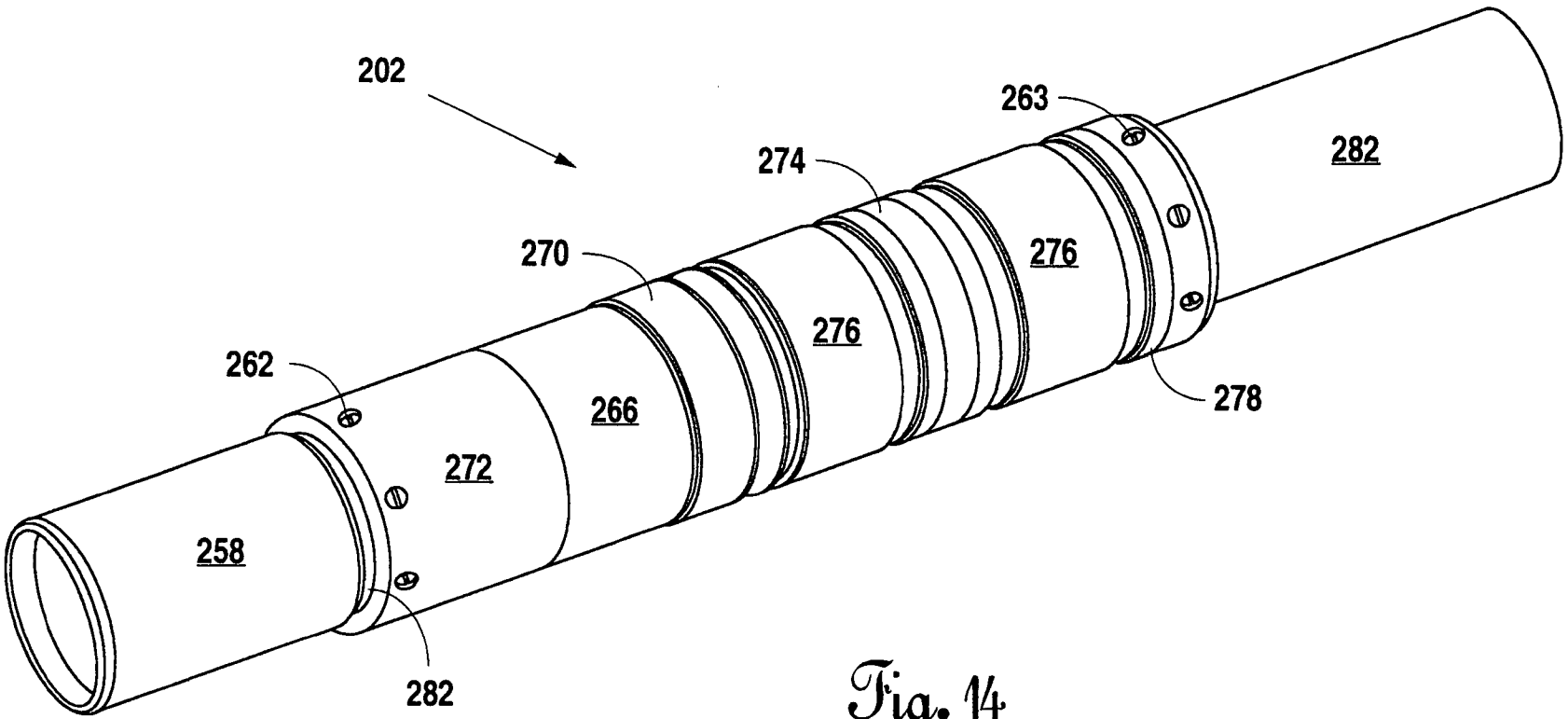
FIG. 14 is a perspective view of a packer member of the production tubing system embodying the present invention.
Figure 15:
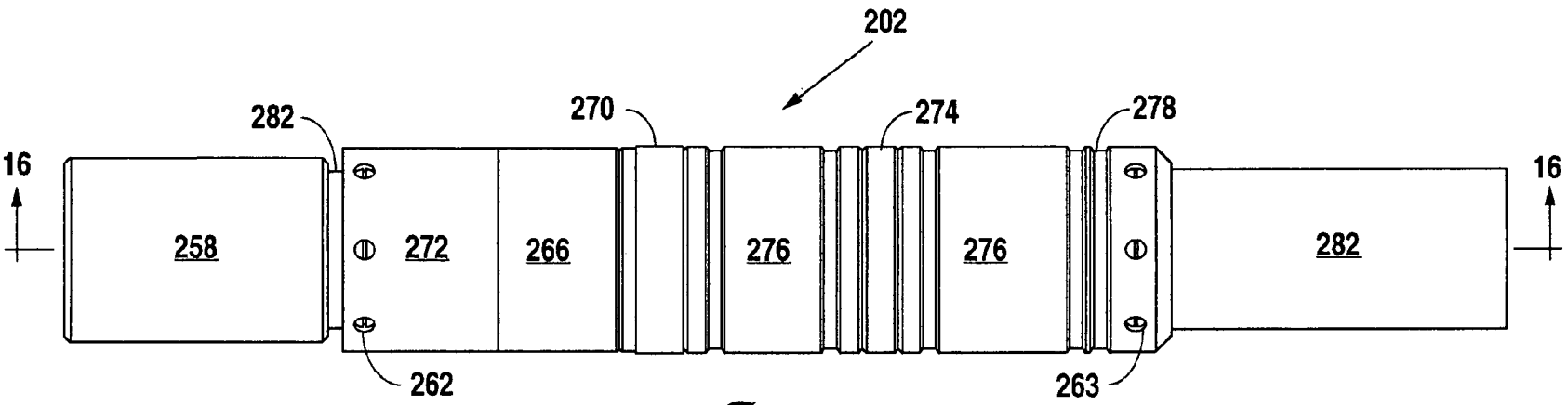
FIG. 15 is a side view of the packer member of the production tubing system embodying the present invention.

FIG. 14 depicts a perspective view of the open hole packer 202 of a preferred embodiment of the present invention, while FIG. 15 shows a side view of the packer 202. A plurality of shear pins 262 fasten a lock housing 272 to the mandrel 282 adjacent a thimble adapter 266, to which is attached an upper thimble 270. A shear ring 278 is fastened to the mandrel 282 by a plurality of shear pins 263. Between the shear ring 278 and the upper thimble 270 are two rubber seals 276 separated by a spacer 274. Neither the rubber seals 276 nor the spacer 274 are fastened to the mandrel 282.

Figure 16:
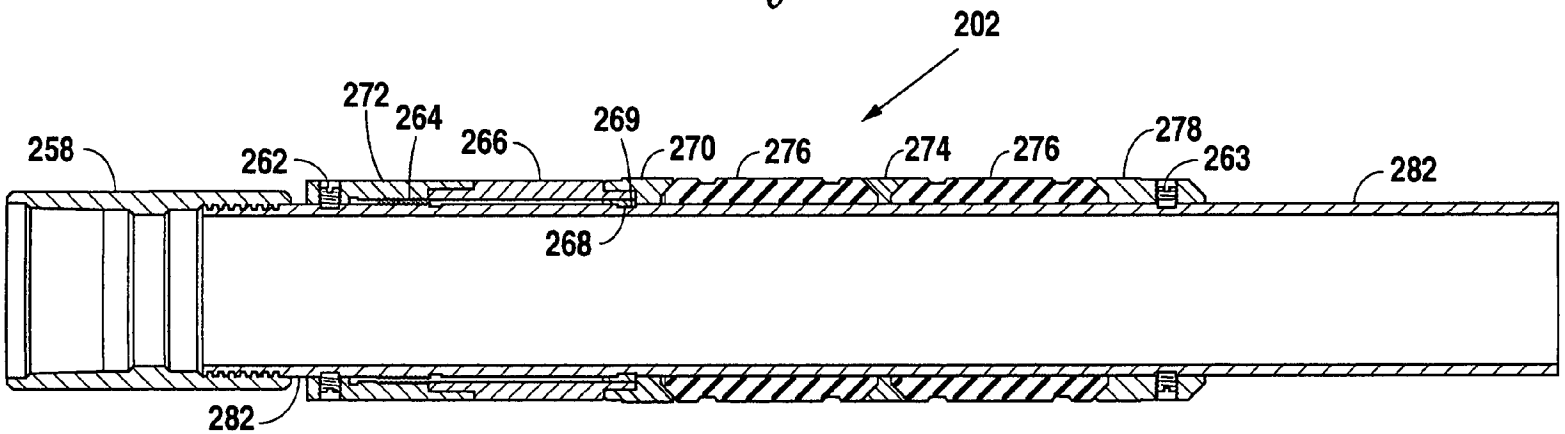
FIG. 16 is a longitudinal sectional view of the packer member of the production tubing system embodying the present invention.

FIG. 16 is a longitudinal cross section of FIG. 15 along section lines 16-16 and shows how the packer 202 can be set and then, if so desired, later released. After the anchor 204, shown in FIGS. 10 through 13, has been set, a well operator causes enough compression force on the lock housing 272 of the packer 202 to shear the shear pins 262. After the shear pins 262 break, the operator can move the lock housing 272, thimble adaptor 266, and upper thimble 270 along the mandrel 282 toward the rubber seals 276. A lock 264, however, allows movement in only this direction, and prevents these elements from moving up the mandrel 282 toward a top connection 258. A split ring 268 is positioned in a groove 269 of the mandrel 282 and acts as a mechanical stop to keep the upper thimble 270 from moving past the split ring 268. As an external force moves the lock housing 272, the thimble adaptor 266, and the upper thimble 270 toward the rubber seals 276, the thimble adaptor 270 compresses the rubber seals 276 along their cylindrical axes, causing the rubber seals 276 to bulge radially outward from the mandrel 282 and into the wall 300 of the lateral 26 (see FIG. 17). This seals the well at the point of the packer 202, and more specifically at the point of the rubber seals 276, from the backflow of gas, fluid, or cement.

If it is later desired to unset the rubber seals 276, a well operator causes enough compression force on the lock housing 272, which is then transmitted through the thimble adaptor 266, the upper thimble 270, the rubber seals 276, and the shear ring 278, to shear the shear pins 263. After the shear pins 263 break, the shear ring 278 is pushed down the mandrel 282 by the rubber seals 276, which return to their unstressed and uncompressed state. This breaks the seal between the packer 202 and the wall 300 of the lateral 26 (see FIG. 17). The shear strength of the downwell shear pins 263 is greater than the shear strength of the upwell shear pins 262 to avoid shearing both sets of pins when setting the packer 202.

FIG. 17 shows production tubing sections 304*a*, 304*b*, representative of the present invention, installed and being installed in a multilateral production well 10. The production well 10 is drilled into the earth 12 to a hydrocarbon production zone 14. A well operator controls operation of the well through wellhead 108, which attaches to a production casing 16 at the surface. This allows for a well operator to perform normal production functions, such as check the pressure in the well or pump fluid into the well.

At the lower end of the production casing 16, the work string 207 protrudes through the casing 16 and into the production zone 14. In the production zone 14 are drilled an upper lateral 24, in which a production tubing system 304*a* embodying the present invention has been previously installed, and a lower lateral 26, in which a production tubing system 304*b* embodying the present invention is being installed. Fluid cement material 500 lines the wellbore along the upper lateral 24 and will harden over time.

In carrying out the method for cementing production tubing in a predefined lateral 26 of a multilateral production well 10, production tubing, or more specifically the production tubing system 304*b* embodying another aspect of the present invention, is run into the lower lateral 26 until the anchor 204 and the packer 202 are advanced beyond a junction 400 of the upper lateral 24 with the lower lateral 26. In carrying out the present invention, it should be noted that either earlier- or later-formed laterals may branch off of the main wellbore instead of another lateral. After the production tubing section 304*b* is run into the lateral 26, it is secured in place by setting the anchor 204 as a result of expanding the slips 246 (see FIGS. 12, 13) and engaging the slip teeth 246*a* (see FIGS. 12, 13) against the wall 300 of the open lateral 26, as described above. A fluid cement material 500 is injected through the internal bore of the packer 202 and the anchor 204 and through a gathering section 210. The fluid cement material 500 may be discharged from the production tubing system 304*b* through an opening at a distal end 212 of the gathering section 210, through openings at one or more sliding valves 28 as described above, or through other openings provided either before installation of the gathering section 210 or subsequently formed after installation in the lateral 26. The injecting of the fluid cement material 500 is continued for a period of time sufficient to inject an amount of the fluid cement material 500 into the lateral 26 so that the fluid cement material 500 completely surrounds the production tubing system 304*b* along and fills an annular space between the outer surface of the production tubing system 304*b* and an internal surface of the wall 300 of the lateral 26 for the distance from the distal end 212 of the gathering section 210 to a position near or just beyond the packer 202 of the production tubing system 304*b*. Desirably, after the well operator injects the fluid cement material 500 around the production tubing system 304*b* to the packer 202, the packer 202 is set by expanding the rubber seals 276 to form a seal between the packer 202 and the internal surface of the wall 300 of the lateral 26, as shown by the production tubing system 304*a* already installed in the upper lateral 24.

After the packer 202 has been set and a seal formed between the packer 202 and the wall 300 of the lateral 26, as shown by the production tubing system 304*a* located in the upper lateral 24, any fluid cement material 500 remaining in the internal passageways of the production tubing system 304*b* may be removed by means such as flushing, described above with respect to the single lateral production well, or by passing a swab through the production tubing system 304*b*.

After any unwanted fluid cement material 500 is removed from the internal passages of the production tubing system 304*b*, and desirably, the surrounding hydrocarbon production zone 14 fraced in the manner described above, the work string 207 is disconnected from the packer 202 of the production tubing system 304*b*. The junction 400 and all portions of the lateral 26 not sealed off by the expanded packer 202 may be flushed by passing a fluid through the main borehole and thereby removing residual fluid cement material 500 from the lateral borehole 26 and the junction 400. If multiple junctions with other laterals are present, flushing of all the junctions can be carried out simultaneously without the danger of unwanted flushing fluid being directed past the expanded packer 202.

After flushing of the lateral 26 and junction 400, the production tubing system 304*b* can be connected to standard production tubing and oil and gas extracted from the hydrocarbon production zone 14 around the lateral 26 in the conventional manner. In such applications, the production tubing systems 304*a*, 304*b* remain in place during production.

It should be noted that in the production tubing systems 304*a*, 304*b* embodying the present invention, the anchor 204 is set hydraulically prior to mechanically setting the packer 202. Importantly, this sequence assures that the production tubing systems 304*a*, 304*b* are secured in place prior to providing a seal of the annular area to be filled with cement. If the anchor 204 is not set first, the production tubing system 304*b* may shift during injection of the fluid cement material 500 to a position where the packer 202 is exposed or even has passed above the junction 400 and the junction 400 is inadvertently filled with fluid cement material 500. In addition, without setting the anchor 204, there is no means by which the apparatus can resist the compressive forces that must be exerted by the well operator to later set the packer 202.

The present invention is particularly useful in extracting oil and gas from hydrocarbon production zones where multilateral boreholes are used to cover a wider production zone with a single wellhead. Not only is the production increased as a result of fracing the production zone around each lateral in the manner described herein, but also by avoiding undesired contamination of a subsequently-formed lateral with a main or other lateral bores.

The present invention is described above in terms of a preferred illustrative embodiment in which a specifically described packer, anchor, and gathering tubing are described. Those skilled in the art will recognize that alternative constructions of a hydraulically actuated anchor, a mechanically actuated packer, and differently constructed gathering tubing can be used in carrying out the present invention.

Other aspects, features, and advantages of the present invention may be obtained from a study of this disclosure and the drawings, along with the appended claims.

I claim:

1. A method for cementing production tubing in a predefined lateral of a multilateral borehole, comprising:

running production tubing into said predefined lateral, said production tubing having a distal end, an anchor and a packer spaced from the distal end, and a work string removably attached to the packer, said running of the production tubing being continued until said packer and said anchor are advanced beyond a junction of lateral boreholes;

setting said anchor and securing said production tubing in a fixed relationship with said predefined lateral;

injecting a fluid cement material through said production tubing, out of at least one opening therein and around an annular space around the production tubing defined between a external surface of the production tubing and an internal surface of said predefined lateral, said injecting being continued for a period of time sufficient to substantially fill said annular space around the production tubing from said distal end approximately to said packer with said fluid cement material; and subsequently setting said packer and forming a fluid seal between said production tubing and said internal surface of said predefined lateral.

2. The method for cementing production tubing, set forth in claim 1 wherein subsequent to setting said packer said method includes removing fluid cement material deposits from the production tubing.

3. The method for cementing production tubing, as set forth in claim 2, wherein said removing fluid cement material from the production tubing includes flushing said tubing with a liquid material.

4. The method for cementing production tubing as set forth in claim 2, wherein said removing fluid cement material from the production tubing includes passing a swab through said production tubing.

5. The method for cementing production tubing as set forth in claim 2, wherein subsequent to removing fluid cement material from the production tubing, said method includes disconnecting said work string from the distal end of said packer.

6. The method for cementing production tubing as set forth in claim 5 wherein subsequent to disconnecting said working tubing from the distal end of the packer, said method includes flushing said borehole and removing any residual fluid cement material from said borehole and said junction.

7. The method for cementing production tubing set forth in claim 6 wherein a junction is defined between each of said multiple lateral boreholes and a central wellbore and said flushing said borehole and removing any residual fluid cement material from said borehole and said junction includes removing any residual fluid cement material from each of said junctions.

8. The method for cementing production tubing set forth in claim 1 wherein said setting said anchor includes hydraulically expanding at least one radially outwardly moveable member of said anchor.

9. The method for cementing production tubing set forth in claim 1 wherein said setting said packer includes mechanically expanding at least one radially outwardly moveable member of said packer.

10. The method for cementing production tubing as set forth claim 1 wherein said injecting a fluid cement material includes injecting an amount of said fluid cement material sufficient to substantially fill said annular space around the production tubing from said distal end to said packer.

* * * * *